United States Patent [19]

Hoffmann

[11] 4,289,309

[45] Sep. 15, 1981

[54] WORK CONTROL ASSEMBLY IN AN EXERCISER

[75] Inventor: Ralph L. Hoffmann, St. Louis, Mo.

[73] Assignee: The Perfection Manufacturing Company, St. Louis, Mo.

[21] Appl. No.: 93,920

[22] Filed: Nov. 13, 1979

[51] Int. Cl.[3] ..... A63B 23/04

[52] U.S. Cl. ..... 272/73; 74/529; 188/72.7; 188/24.18; 272/132

[58] Field of Search ..... 272/73, 128, 131, 132, 272/134, DIG. 4; 188/24, 25, 26, 27, 72.9, 72.7, 265, 83; 74/529

[56] References Cited

U.S. PATENT DOCUMENTS

| | | | |
|---|---|---|---|
| 1,266,418 | 5/1918 | Dawson | 188/24 X |
| 1,341,325 | 5/1920 | Kainen | 188/265 X |
| 2,207,386 | 7/1940 | Tampier | 74/529 X |
| 3,125,341 | 3/1964 | Carrington | 272/73 |
| 3,567,250 | 3/1971 | Wolf | 188/24 X |
| 3,651,897 | 3/1972 | Hahn | 188/72.7 X |
| 3,833,216 | 9/1974 | Philbin | 272/73 |
| 3,995,491 | 12/1976 | Wolfla | 272/73 X |

FOREIGN PATENT DOCUMENTS

| | | | |
|---|---|---|---|
| 546503 | 4/1956 | Belgium | 188/72.7 |
| 376748 | 6/1907 | France | 188/24 |
| 445436 | 2/1949 | Italy | 188/24 |

*Primary Examiner*—Richard C. Pinkham
*Assistant Examiner*—Arnold W. Kramer
*Attorney, Agent, or Firm*—Cohn, Powell & Hind

[57] ABSTRACT

A work control assembly in a bicycle exerciser having a driven member rotatively mounted on a frame. The work control assembly includes a brake which engages the driven member. A lever is pivotally carried by the frame and connected to the brake for exerting braking pressure on the driven member. The brake is spring loaded, the spring tends to resist the pivotal movement of the lever in one direction. A pivotally mounted control arm engages the lever to pivot the lever and to hold the lever in a selected pivoted position against the action of the spring loading. The lever and the control arm are pivotally mounted to a plate which is attached to the frame. The plate includes a plurality of holes located along an arcuate path. The control arm selectively interfits the holes for holding the lever in a predetermined position for determining braking pressure applied to the rotatively mounted driven member.

5 Claims, 5 Drawing Figures

WORK CONTROL ASSEMBLY IN AN EXERCISER

BACKGROUND OF THE INVENTION

This invention relates generally to improvements in work control apparatus in an exerciser, and more particularly to an improved apparatus in a bicycle exerciser providing a means of selectively predetermining and maintaining the brake pressure.

For example, a prior work control apparatus has a lever that is selectively rotated to determine braking pressure applied to a driven member. The device requires separate adjustment and locking for the lever, resulting in both increased cost of construction and difficulty of operation than would exist if when the control and locking means were included in the same element.

SUMMARY OF THE INVENTION

The present work control apparatus overcomes the functional disadvantages of the previously mentioned prior device by permitting adjustment and locking of the braking lever by employing a single control means.

The present work control apparatus includes a brake means operatively mounted on the exerciser frame and engaging a driven member, and a lever means pivotally carried by the exerciser frame and connected to the brake means for exerting braking pressure on the driven member. A resilient means is operatively connected between the brake means and the lever means, and tends to resist pivotal movement of the lever means in one direction. A control means is movably carried by the frame and slidably engages the lever means for pivoting the lever means and holding the lever means in a selected pivoted position against the action of the resilient means for determining the braking pressure applied to the driven member.

The control means includes a pivotally mounted arm slidably engaging the lever means for pivoting the lever means. The control means includes a locking means for retaining the control arm in an adjusted predetermined position.

In one aspect of the invention, a plate is mounted to the frame, and a control arm is pivotally mounted to the plate. The control arm engages the lever means for pivoting the lever means. The control means includes a locking means which is provided with a plurality of holes located along an arcuate path in a plate. The control arm selectively interlifts the holes for holding the control arm in a predetermined position. The control arm includes an aperture aligned with and following the arcuate path of the plurality of plate holes. When the control arm is pivoted, a spring-mounted ball, retained in the arm aperture, slidably and rotatively bears on the plate. The ball engages the plate holes to retain the arm in the selected predetermined position.

In one aspect of the invention, the control arm is located adjacent to the plate and, the plate including an arcuate margin. The lever means includes a bearing margin located adjacent to the plate. The arm includes a laterally projecting bearing pin, the bearing pin engaging the lever bearing margin. The bearing pin includes a head, the head maintaining the lever means laterally between the plate and the head.

Figure 1:
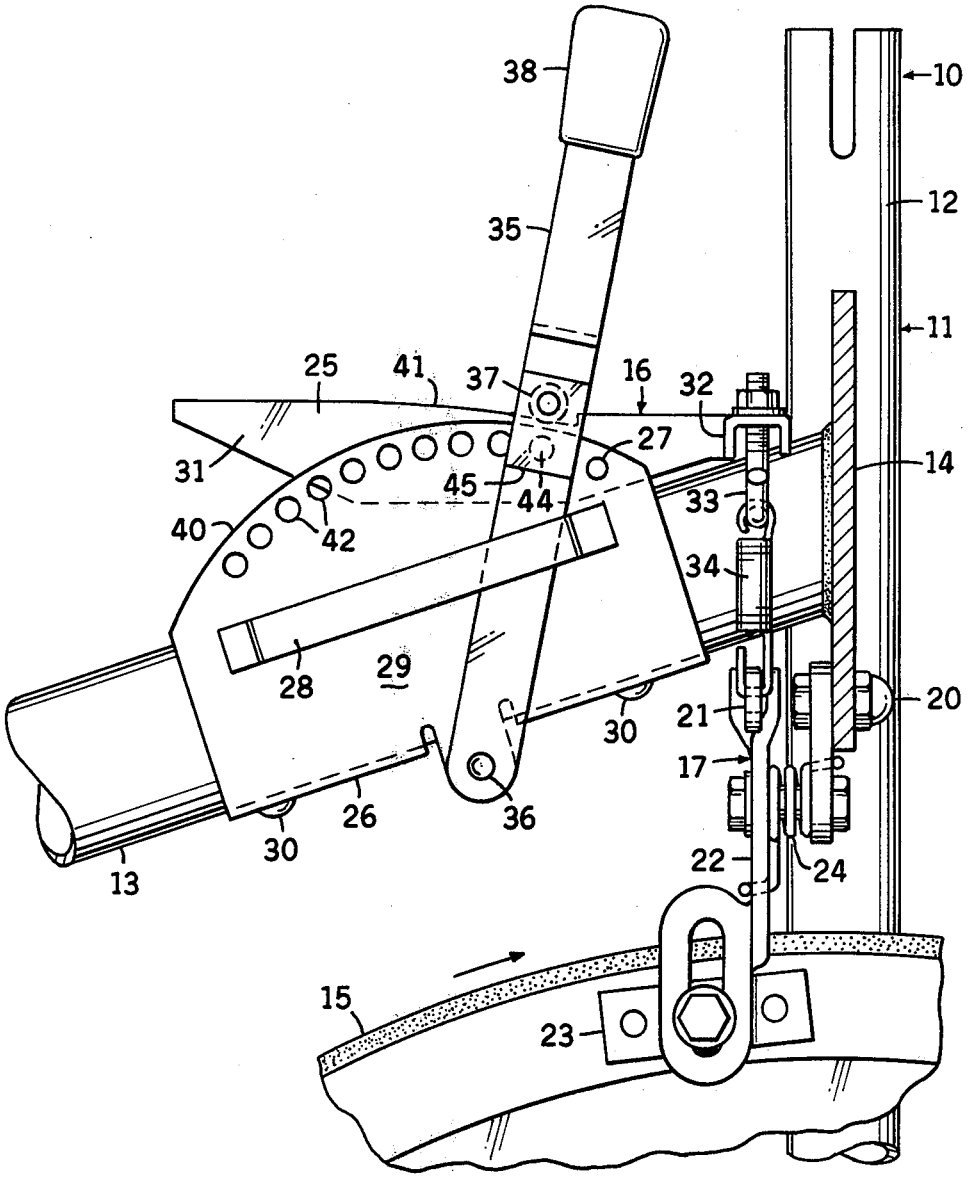
FIG. 1 is a side elevational view of the work control assembly.
Figure 2:
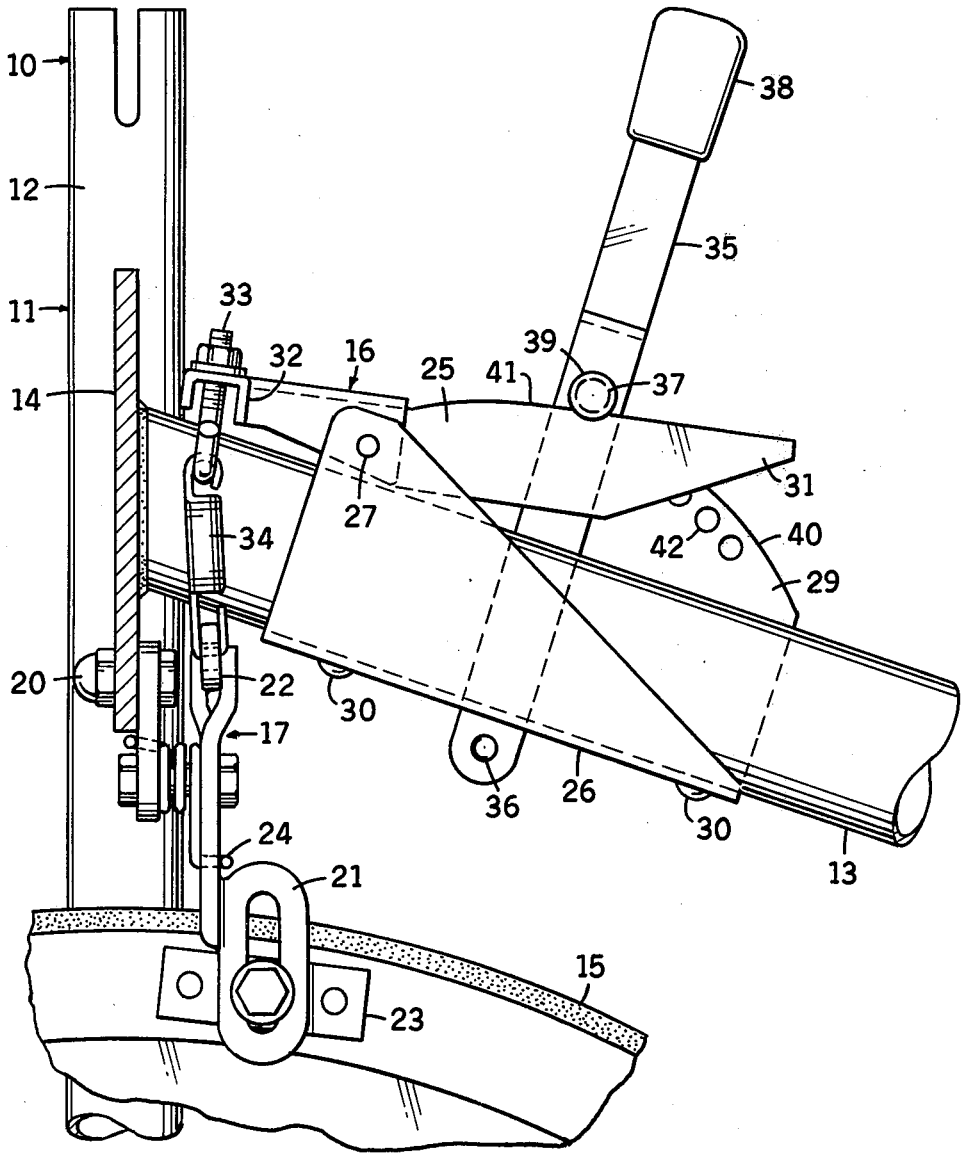
FIG. 2 is an elevational view of the opposite side of the work control assembly.
Figure 3:
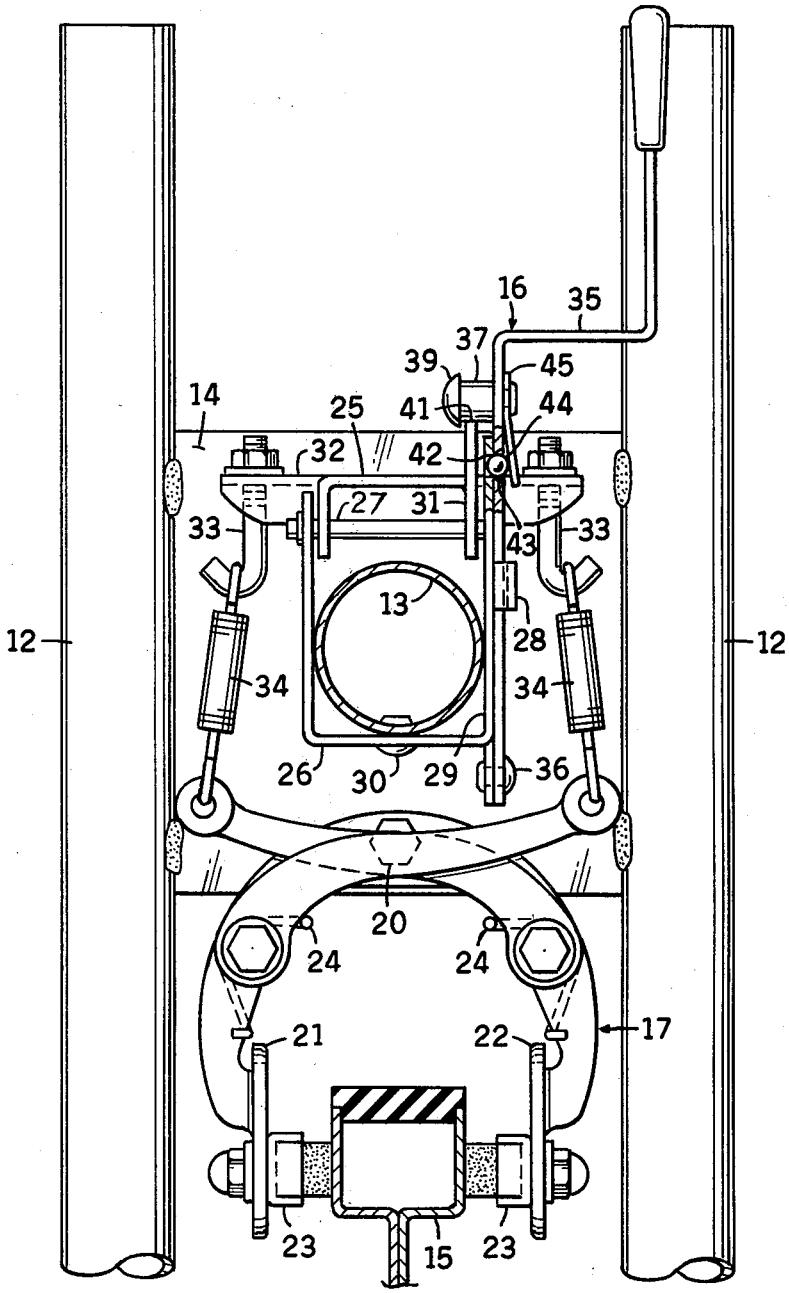
FIG. 3 is a rear view of the work control assembly as seen from the left of FIG. 1.
Figure 4:
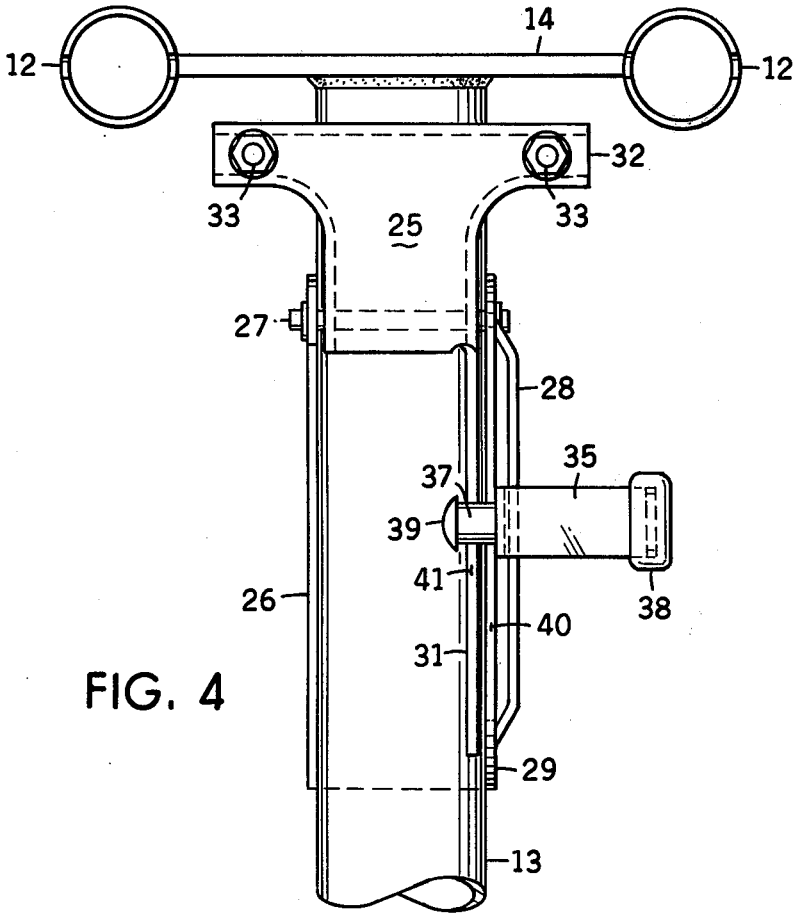
FIG. 4 is a top plan view of the control means shown in FIG. 1.
Figure 5:
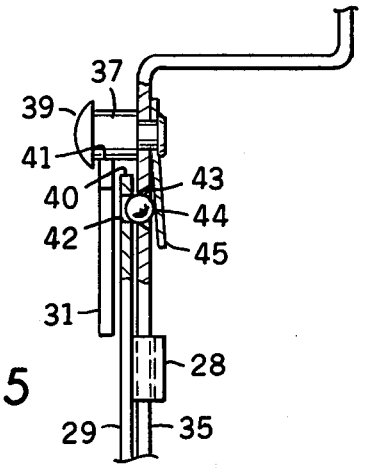
FIG. 5 is an enlarged fragmentary view, partly in section, of the locking means.

DESCRIPTION OF THE PREFERRED EMBODIMENT:

Referring now by characters of reference to the drawings, and first to FIGS. 1 and 3, it will be understood that the exerciser 10 is of a bicycle type.

The exerciser includes a frame 11 having a front fork portion 12 and an intermediate longitudinal portion 13 attached by an end plate 14 as by welding to the fork portion 12. As is conventional, a wheel 15, constituting a driven member, is rotatively mounted between the fork portion 12 and below the longitudinal frame portion 13. As is also conventional, an appropriate drive means such as a foot pedal and sprocket-chain connection with the driven wheel 15 is provided, but not shown, whereby the user can rotate the driven wheel 15 by leg power.

The work control assembly is generally indicated by 16 and includes a caliper brake assembly 17 which is mounted to the end plate 14 by a fastener 20. The caliper brake assembly 17 includes double-pull caliper brake elements 21 and 22, which are each provided with a wheel engageable brake shoe 23 and a return spring 24. In effect, the brake shoes 23 provide a brake means, and the return springs 24 a resilient means tending to urge the shoes 23 out of engagement with the driven member 15.

A lever means 25 is pivotally attached to a bracket 26 by a pivot pin 27. The bracket 26 is carried by the frame 11 and is attached to the longitudinal frame portion 13 as by rivets 30. One side of the bracket 26 constitutes a plate 29. The lever 25 includes a longitudinal portion 31 located rearwardly of the pivot pin 27, and a transverse portion 32 located forwardly of the pivot pin 27. The transverse lever portion 32 is connected to the caliper brake elements 21 and 22 by J-bolts 33 and connecting springs 34. The return springs 24 tend to resist pivotal movement of the transverse lever portion 32 in an upward or counterclockwise direction as viewed in FIG. 1. The counterclockwise rotation of the lever 25 against the loading of return springs 24 causes the brake shoes 23 to exert braking pressure on the wheel 15.

Control means includes a pivotally mounted arm 35 which is attached to the plate 29 by a pivot 36. The plate 29 includes a guide 28 punched from the plate 29. The arm 35 is located adjacent to the plate 29 between the guide 28 and the plate 29. The control arm 35 includes a laterally projecting bearing pin 37, and a handle portion 38. The plate 29 includes an upper arcuate edge 40, the bearing pin 37 extending from the control arm 35 and beyond the plate edge 40. The longitudinal lever portion 31 is located adjacent to the plate 29, the bearing pin 37 slidably engaging a bearing margin 41 on the longitudinal lever portion 31 for pivoting the lever 25.

The bearing pin 37 includes a head 39 of larger diameter than the pin 37. The longitudinal lever portion 31 is maintained laterally between the plate 29 and the head 39.

The plate 29 includes a plurality of holes 42 located on an arc about the pivot 36. The control arm 35 includes an aperture 43 aligned with and following the arcuate path of the plurality of plate holes 42 when the arm 35 is pivoted. A spring-mounted ball 44 having a diameter greater than the diameter of the holes 42 is retained in the arm aperture 43 by a steel flexible leaf spring 45. In the preferred embodiment, the spring 45 is attached to the arm 35 at the bearing pin 37. The spring-mounted ball 44 slidably and rotatably bears on the plate 29, and selectively engages the plate holes 42 to retain the arm 35 and lever 25 in a predetermined position for determining the braking pressure.

It is thought that the structural features and functional advantages of this work control assembly have become fully apparent from the foregoing description of parts, but for completeness of disclosure the operation of the assembly will be briefly discussed.

It is, of course, understood that the wheel 15 is driven in a conventional manner with the work control assembly providing means for exerting braking pressure on the wheel 15, and thereby selectively determining the work required to rotate the wheel 15. In order for the operator to increase the braking pressure, the control arm 35 as viewed in FIG. 1 is manually moved in a counterclockwise direction. As the control arm 35 is rotated counterclockwise, the bearing pin 37 engages the lever 25 and causes the lever 25 to be rotated in a counterclockwise direction. The lever 25 through the J-bolts 33 and connecting springs 34 pull the brake elements 21 and 22 against the tension of the springs 24, causing the brake shoes 23 to apply greater pressure to the wheel 15. The ball 44 in the arm aperture 43 is manually positioned to engage one of the plate holes 43 for locking the arm 35 and lever 25 in a selected position, thereby determining the braking pressure applied to the wheel 15. It will be understood that upon application of sufficient rotative force to the arm 35, the ball 44 is forced into the arm aperture 43 against the tension of the spring 45 and slidably and rotatively engages the plate 29 as the arm 35 is rotated. The spring 45 urges the ball 44 to engage a plate hole 42 for locking the arm 35 in a selected position.

When it is desired to decrease the braking pressure applied to the wheel 15, the arm 35 is manually rotated in a clockwise direction, thereby allowing the lever 25 to rotate clockwise and relax the pressure of the brake shoes 23 on the wheel 15. The work control assembly can be easily reset to a desired work pressure by rotating the arm 35 to a position where the ball engages a predetermined hole 42.

I claim as my invention:

1. A work control assembly in an exerciser having a frame, and a driven member rotatively mounted on the frame, the assembly comprising:

(a) a brake means operatively mounted on the exerciser frame and engaging the driven member, (b) a lever means pivotally carried by the frame and connected to the brake means for exerting braking pressure on the driven member, (c) resilient means operatively connected between the brake means and lever means tending to resist pivotal movement of the lever means in one direction, (d) control means movably carried by the frame and slidably engaging the lever means for pivoting the lever means and holding the lever means in a selected pivoted position against the action of the resilient means for determining the braking pressure, (e) the lever means including a bearing margin, (f) the control means including a pivotably mounted arm slidably engaging the lever means along the bearing margin for pivoting the lever means while slidingly engaging the lower means, and (g) the control means including a locking means for retaining the control arm in an adjusted predetermined position.

2. A work control assembly in an exerciser having a frame, and a driven member rotatively mounted on the frame, the assembly comprising:

(a) a brake means operatively mounted on the exerciser frame and engaging the driven member, (b) a lever means pivotally carried by the frame and connected to the brake means for exerting braking pressure on the driven member, (c) resilient means operatively connected between the brake means and lever means tending to resist pivotal movement of the lever means in one direction, (d) control means movably carried by the frame and slidably engaging the lever means for pivoting the lever means and holding the lever means in a selected pivoted position against the action of the resilient means for determining the braking pressure, and (e) the control means including:

1. a plate mounted to the frame,
2. a control arm pivotally mounted to the plate, the control arm slidably engaging the lever means for pivoting the lever means while slidingly engaging the lever means, and
3. a locking means provided with a plurality of holes located along an arcuate path in the plate, the control arm selectively interfitting the holes for holding the control arm in a predetermined position between the limits of travel at the control arm.

3. A work control assembly in an exerciser as defined in claim 2, in which:

(f) the control arm includes an aperture aligned with and following the arcuate path of the plurality of plate holes when the control arm is pivoted, and (g) a spring-mounted ball is retained in the arm aperture, and slidably and rotatively bears on the plate, the ball engaging the plate holes to retain the arm in the predetermined position.

4. A work control assembly in an exerciser having a frame, and a driven member rotatively mounted on the frame, the assembly comprising:

(a) a brake means operatively mounted on the exerciser frame and engaging the driven member, (b) a lever means pivotally carried by the frame and connected to the brake means for exerting braking pressure on the driven member, (c) resilient means operatively connected between the brake means and lever means tending to resist pivotal movement of the lever means in one direction, (d) control means movably carried by the frame and slidably engaging the lever means for pivoting the lever means while slidingly engaging the lever means and holding the lever means in a selected pivoted position against the action of the resilient means for determining the braking pressure, (e) the control means including:

1. a plate mounted to the frame, and 2. a control arm pivotally mounted to the plate, the control arm engaging the lever means for pivoting the lever means, (f) the control arm being located adjacent to the plate, (g) the plate including an arcuate margin, (h) the lever means including a bearing margin located adjacent to the plate, and (i) the control arm including a laterally projecting bearing pin, the bearing pin slidably engaging the lever bearing margin for rotating the lever.

5. A work control assembly in an exerciser as defined in claim 4, in which:

(j) the bearing pin includes a head, the head maintaining the lever means between the plate and head for maintaining lateral alignment of the lever means.

* * * * *

UNITED STATES PATENT AND TRADEMARK OFFICE

CERTIFICATE OF CORRECTION

PATENT NO. : 4,289,309

DATED : September 15, 1981

INVENTOR(S) : Ralph L. Hoffmann

It is certified that error appears in the above-identified patent and that said Letters Patent are hereby corrected as shown below:

Column 1:

Line 52, cancel "interlifts" and substitute --interfits--.

Column 4:

Line 8, cancel "lower" and substitute --lever--.

Signed and Sealed this

*Third* Day of *November 1981*

[SEAL]

*Attest:*

GERALD J. MOSSINGHOFF

*Attesting Officer* *Commissioner of Patents and Trademarks*